US010161143B2

(12) United States Patent
Wang

(10) Patent No.: US 10,161,143 B2
(45) Date of Patent: Dec. 25, 2018

(54) PLASTERING MACHINE HAVING FOLDABLE UPRIGHT RAIL

(71) Applicant: FOSHAN TUPO MACHINERY MANUFACTURE CO., LTD., Foshan (CN)

(72) Inventor: Jianhu Wang, Foshan (CN)

(73) Assignee: FOSHAN TUPO MACHINERY MANUFACTURE CO., LTD., Foshan (CN)

( * ) Notice: Subject to any disclaimer, the term of this patent is extended or adjusted under 35 U.S.C. 154(b) by 0 days.

(21) Appl. No.: 15/550,024

(22) PCT Filed: Jan. 26, 2016

(86) PCT No.: PCT/CN2016/072096
§ 371 (c)(1),
(2) Date: Aug. 10, 2017

(87) PCT Pub. No.: WO2016/188137
PCT Pub. Date: Dec. 1, 2016

(65) Prior Publication Data

US 2018/0038119 A1 Feb. 8, 2018

(30) Foreign Application Priority Data

May 26, 2015 (CN) ..... 2015 1 0276048

(51) Int. Cl.
*E04F 21/00* (2006.01)
*E04F 21/08* (2006.01)
(Continued)

(52) U.S. Cl.
CPC ..... *E04F 21/08* (2013.01); *E04F 21/02* (2013.01); *E04F 21/026* (2013.01); *E04F 21/16* (2013.01); *B05C 11/028* (2013.01)

(58) Field of Classification Search
CPC ..... E04F 21/08; E04F 21/02; E04F 21/026; E04F 21/06; E04F 21/16; B05C 11/028;
(Continued)

(56) References Cited

U.S. PATENT DOCUMENTS 5,578,327 A * 11/1996 Tan ..... E04F 21/08 401/131
2001/0030080 A1* 10/2001 Chick ..... E04G 1/24 182/16
2004/0168854 A1* 9/2004 Azran ..... E04F 21/08 182/141

FOREIGN PATENT DOCUMENTS

CN 2934461 Y 8/2007
CN 202882368 U 4/2013
(Continued)

*Primary Examiner* — Laura Edwards
(74) *Attorney, Agent, or Firm* — Gokalp Bayramoglu

(57) ABSTRACT

A plastering machine having foldable upright rails includes a base (1), upright rails (2), and a plastering pedestal (3), wherein the upright rails (2) are mounted on the base (1). The upright rails (2) include a first left rail piece (6) and a second left rail piece (7) which are connected to each other by a first left rail articulation piece (16) and a second left rail articulation piece (17). The right rail (5) includes a first right rail piece (8) and a second right rail piece (9) which are connected to each other by a first right rail articulation piece (18) and a second right rail articulation piece (19). The left rail (4) and the right rail (5) can ordinarily be in a folded state. The plastering machine has a simple structure, and is convenient to carry and operate, and has a high construction efficiency.

10 Claims, 12 Drawing Sheets

(51) Int. Cl.
*E04F 21/02* (2006.01)
*E04F 21/16* (2006.01)
*B05C 11/02* (2006.01)

(58) Field of Classification Search
CPC .. B05C 11/04; B05C 11/042; E04G 2001/242
USPC ..... 182/141
See application file for complete search history.

(56) References Cited

FOREIGN PATENT DOCUMENTS

| | | | | |
|---|---|---|---|---|
| CN | 203755619 | U | | 8/2014 |
| CN | 104563462 | A | | 4/2015 |
| CN | 104831911 | A | | 8/2015 |
| CN | 204662901 | U | | 9/2015 |
| KR | 20110137135 | A | | 12/2011 |
| WO | WO-2012/028156 | | * | 3/2012 |

* cited by examiner

PLASTERING MACHINE HAVING FOLDABLE UPRIGHT RAIL

CROSS REFERENCE TO RELATED APPLICATIONS

This application is the national phase entry of International Application No. PCT/CN2016/072096, filed on Jan. 26, 2016, which is based upon and claims priority to Chinese Patent Application No. 201510276048.X filed on May 26, 2015, the entire contents of which are incorporated herein by reference.

TECHNICAL FIELD

The present invention relates to a plastering machine, particularly to a platform for a plastering machine having a structure of foldable upright pole.

BACKGROUND

Compared to applying cement mortar onto the wall manually, the plastering machine has the advantages of higher efficiency, time and labor saving, etc.

The existing plastering machine is generally provided with a set of upright rails. The set of upright rails is usually composed of two rails that are arranged uprightly and in parallel. The two rails are referred to as the left rail and the right rail respectively. Each of the left rail and the right rail is provided with a rack. The plastering machine head is provided with a driving gear. The plastering machine head can move up and down along the upright rails through the cooperation between the driving gear and the rack, such that the functions of a bottom-up plastering and a top-down press polish can be achieved.

However, the upright rails of the plastering machine have a fixed length. Since generally the story height of current residential building is about 3 meters, it is required that the length of the rails should also be about 3 meters. Nonetheless, usually the height of the doorway is only about 2 meters. Thus, the upright rails need to be tilted or disassembled to pass through the doorway, which is not convenient to a worker to do so and disassembling the upright rails greatly reduces the working efficiency.

For the above reasons, artisans in the industry have developed a plastering machine having adjustable upright rails. For example, a plastering machine having adjustable upright rails is disclosed in the patent document with the issuance No. CN 203755619 U. The upright rails of the plastering machine are adjustable and retractable. The plastering machine with the rails in a retracted status is very easy to pass through the doorway of a residential building. The use and operation of the plastering machine are very convenient. However, during the plastering process of the plastering machine, the first clamping piece of the plastering machine head needs to cover the resistant portion of the lever piece of the first resistant device to successfully pass through the first resistant device, so as to make the plastering machine head move from the first left rail piece to the third left rail piece. Even if the first clamping piece of the plastering machine head does not cover the resistant portion of the lever piece of the first resistant device, the plastering machine head will keep ascending to force the first clamping piece passing through the first resistant device. In that case, the first clamping piece and even the plastering machine head will be damaged. In addition, such type of plastering machine needs to be installed with an additional hydraulic cylinder as a transmission part of the upright rails, thereby increasing the manufacturing cost of the plastering machine.

Therefore, the plastering machine needs to be improved.

SUMMARY

An object of the present invention is to provide a plastering machine which is easy to be moved and transported. The plastering machine has a low cost. The upright rails of the plastering machine are foldable, which makes it easy for a worker to carry the plastering machine through the doorway. The use of the plastering machine is convenient.

To achieve the above object, the present invention adopts the following technical solutions.

A plastering machine having foldable upright rails includes a base, upright rails, and a plastering machine pedestal. The upright rails are mounted on the base. Specifically, the upright rails include a left rail and a right rail. The left rail includes at least a first left rail piece and a second left rail piece. The right rail includes at least a first right rail piece and a second right rail piece.

The first left rail piece is mounted on the base. The second left rail piece is located downstream with respect to the first left rail piece along an ascending direction of the plastering machine pedestal. The second left rail piece can rotate around a longitudinal tail end of the first left rail piece with respect to the first left rail piece. The first right rail piece is also mounted on the base. The second right rail piece is located downstream with respect to the first right rail piece along the ascending direction of the plastering machine pedestal. The second right rail piece can rotate around a longitudinal tail end of the first right rail piece with respect to the second right rail piece.

Each of the first left rail piece, the second left rail piece, the first right rail piece, and the second right rail piece is provided with a moving groove and an accommodating groove arranged along the longitudinal direction thereof. A first moving base surface is formed inside the moving groove. A rack is arranged inside the accommodating groove along a longitudinal direction of the accommodating groove.

The plastering machine pedestal is provided with a driving motor. An output shaft of the driving motor is connected to a gear. The gear is individually rotatable with respect to the driving motor and engages with the rack. The plastering machine pedestal is further provided with a first moving wheel group and a second moving wheel group. The first moving wheel group and the second moving wheel group are individually rotatable with respect to the plastering machine pedestal. The first moving wheel group moves on the first moving base surface. The second moving wheel group moves on a second moving base surface. The second moving base surface is formed on an outer side of the accommodating groove. The second moving base surface is parallel to the first moving base surface.

The principles of the present invention are as follows.

The plastering machine pedestal is mounted inside the upright rails and between the left rail and the right rail. Normally, the second left rail piece turns around the longitudinal tail end of the first left rail piece toward the outer side of the first left rail piece to closely fit the first left rail piece, such that the first left rail piece and the second left rail piece are in a folded state. The second right rail piece also turns around the longitudinal tail end of the first right rail piece toward the outer side of the first right rail piece to closely fit the first right rail piece, such that the first right rail piece and the second right rail piece are in a folded state. In this situation, the overall height of the upright rails is the shortest, which enables the worker to transport or move the plastering machine easily.

The plastering machine pedestal is driven by the driving motor. Ascending motion from a lower position to a higher position and descending motion from a higher position to a lower position are achieved through the cooperation between the gear and the rack.

Before the plastering machine pedestal moves, a worker turns over the second left rail piece and the second right rail piece to rotate around the longitudinal tail end of the first left rail piece and the longitudinal tail end of the first right rail piece respectively, until the first left rail piece is aligned with the second left rail piece in the longitudinal direction, and the first right rail piece is aligned with the second right rail piece in the longitudinal direction. After that, the first left rail piece and the second left rail piece are in an upright position, and the first right rail piece and the second right rail piece are in the upright position. Subsequently, after a worker starts the driving motor, the gear moves with respect to the rack to drive the plastering machine pedestal to ascend from a lower position to a higher position or descend from a higher position to a lower position. The gear, the first moving wheel group, and the second moving wheel group on the plastering machine pedestal can move smoothly from the racks and the moving grooves of the first left rail piece and the first right rack piece to the racks and the moving grooves of the second left rail piece and the second right rail piece.

A positioning mechanism may be provided between the second left rail piece and the second right rail piece for fixing the relative position of the second left rail piece and the second right rail piece. This will help avoid the situation where the plastering machine fails due to a displacement of the relative position between the second left rail piece and the second right rail piece during the working of the plastering machine. Specifically, the positioning mechanism may include a positioning jutting block and a positioning hook. The positioning jutting block may be arranged either on the second left rail piece or the second right rail piece. The positioning hook is arranged on the other one of the second left rail piece or on the second right rail piece. The positioning hook is individually rotatable with respect to the rail piece on which the positioning hook is located. The positioning hook is formed with a positioning hook portion which can be hooked up to the positioning jutting block. At least one of the second left rail piece and the second right rail piece is provided with a positioning jutting block. That is, the number of the positioning jutting blocks may be more than one. The positioning jutting block may be arranged either on the second left rail piece or on the second right rail piece. If the positioning jutting block is arranged to the second left rail piece, the corresponding positioning hook is arranged to the second right rail piece. If the positioning jutting block is arranged to the second right rail piece, the corresponding positioning hook is arranged to the second left rail piece.

The rotation of the second left rail piece around the longitudinal tail end of the first left rail piece with respect to the first left rail piece may be achieved by an articulation structure. The rotation of the second right rail piece around the longitudinal tail end of the first right rail piece with respect to the first right rail piece may also be achieved by the articulation structure. Specifically, the longitudinal tail end of the first left rail piece is provided with a first left rail articulation piece. Longitudinal head end of the second left rail piece is provided with a second left rail articulation piece. The first left rail articulation piece is mounted to the second left rail articulation piece correspondingly. The first left rail articulation piece is connected to the second left rail articulation piece via a first hinge pin. The longitudinal tail end of the first right rail piece is provided with a first right rail articulation piece. The longitudinal head end of the second right rail piece is provided with a second right rail articulation piece. The first right rail articulation piece is mounted to the second right rail articulation piece correspondingly. The first right rail articulation piece is connected to the second right rail articulation piece via a second hinge pin. When the second left rail piece rotates with respect to the first left rail piece, the second left rail piece rotates around the center axis of the first hinge pin with respect to the first left rail piece. Similarly, when the second right rail piece rotates with respect to the first right rail piece, the second right rail piece rotates around the center axis of the second hinge pin with respect to the first right rail piece. Furthermore, the structure of each of the first left rail articulation piece, the second left rail articulation piece, the first right rail articulation piece, and the second right rail articulation piece is as follows. The structure includes a fixing plate. The fixing plate is formed with at least one articulation lug. The at least one articulation lug is provided with a hinge pin through hole for the first hinge pin or the second hinge pin to pass through.

In addition to the positioning hook portion and the positioning jutting block, the left rail and the right rail may also be provided with other fixing structures for assisting the fixation. For this purpose, each of the longitudinal tail end of the first left rail piece and the longitudinal tail end of the first right rail piece may be provided with a fixing block. Each of the longitudinal head end of the second left rail piece and the longitudinal head end of the second right rail piece may be provided with a fixing pin portion. The fixing pin portion is provided with a fixing hook, which is rotatable with respect to the fixing pin portion. The fixing hook is formed with a hook portion which can be snapped on to the fixing block. The fixing block on the first left rail piece is mounted on the fixing hook on the second left rail piece correspondingly. The fixing block on the first right rail piece is mounted on the fixing hook on the second right rail piece correspondingly. When the second left rail piece is turned over to be aligned longitudinally with the first left rail piece, namely, the first moving base surface of the second left rail piece is in the same upright plane as the first moving base surface of the first left rail piece, the worker can flip the fixing hook so that the hook is snapped on to the fixing block. Thus, the first left rail piece and the second left rail piece are fixed in place. Similarly, the first right rail piece and the second right rail piece are installed.

Each of the first moving wheel group and the second moving wheel group may include a plurality of moving wheels. Each moving wheel is formed with a position limiting rim. The position limiting rim is arranged on an end face of the moving wheel around a rotation axis of the moving wheel. When the first moving wheel group and the second moving wheel group move on the first moving base surface and the second moving base surface respectively, the position limiting rim can closely fit or approximately fit each of the inner end faces of the left rail and the right rail to provide a reliable support for the plastering machine pedestal in a horizontal direction, so that the plastering machine pedestal can stably ascend from a lower position to a higher position or stably descend from a higher position down to a lower position.

The structure of each of the first left rail piece, the second left rail piece, the first right rail piece, and the second right rail piece is as follows. The structure includes two pieces of paralleled channel steel. The moving groove is formed inside either one of the two pieces of channel steel. The accommodating groove is formed inside another one of the two pieces of channel steel. A plurality of connecting rods for fixing is arranged between the two pieces of channel steel. In addition, each of the left side and right side of the base may be provided with the positioning jutting block. A positioning sleeve corresponding to the positioning jutting block is arranged on each of the first left rail piece and the first right rail piece. When the positioning jutting blocks on the base are stuffed into positioning sleeves of the first left rail piece and the first right rail piece respectively, the upright rail is fixed to the base.

In order to ensure that the first left rail piece and the second left rail piece and the first right rail piece and the second right rail piece are in an upright status, the second left rail piece and the second right rail piece may push against the ceiling. Moreover, the base may be provided with a jack. The jack can be the pedal jack in the prior art. The jack is provided with bottom holding claws that can push against the ground. When the first left rail piece and the second left rail piece and the first right rail piece and the second right rail piece are in an upright status, a worker can operate the jack to make the bottom holding claws push against the ground so that the second left rail piece and the second right rail piece push against the ceiling, so as to make the upright rail stand stably between the base and the ceiling, and to ensure that the plastering machine is kept in place during the operation.

The structure of the present invention is simple. The left rail and the right rail can be folded with a simple articulation structure. The cost is low. The plastering machine is easy to move. The operation is convenient. The construction efficiency is high.

DEFINITION OF THE LABELS IN THE DRAWINGS

1—base; 2—upright rail; 3—plastering machine pedestal; 4—left rail; 5—right rail; 6—first left rail piece; 7—second left rail piece; 8—first right rail piece; 9—second right rail piece; 10—channel steel; 11—connecting rod; 12—moving groove; 13—accommodating groove; 14—rack; 15—positioning sleeve; 16—first left rail articulation piece; 17—second left rail articulation piece; 18—first right rail articulation piece; 19—second right rail articulation piece; 20—fixing plate; 21—articulation lug; 22—hinge pin through hole; 23—first hinge pin; 24—second hinge pin; 25—positioning pin; 26—rotary hinge pin; 27—positioning hook; 28—positioning hook portion; 29—fixing hinge pin; 30—fixing hook; 31—hook portion; 32—fixing post; 33—driving motor; 34—driving sprocket; 35—following sprocket; 36—gear; 37—first moving wheel group; 38—second moving wheel group; 39—first moving base surface; 40—first moving wheel; 41—second moving wheel; 42—second moving base surface; 43—position limiting rim; 44—pedal jack; 45—driving shaft; 46—positioning rod; 47—third left rail piece; 48—third right rail piece.

DETAILED DESCRIPTION OF THE INVENTION

The present invention is now further described with reference to the drawings and embodiments.

Embodiment 1

Figure 1:
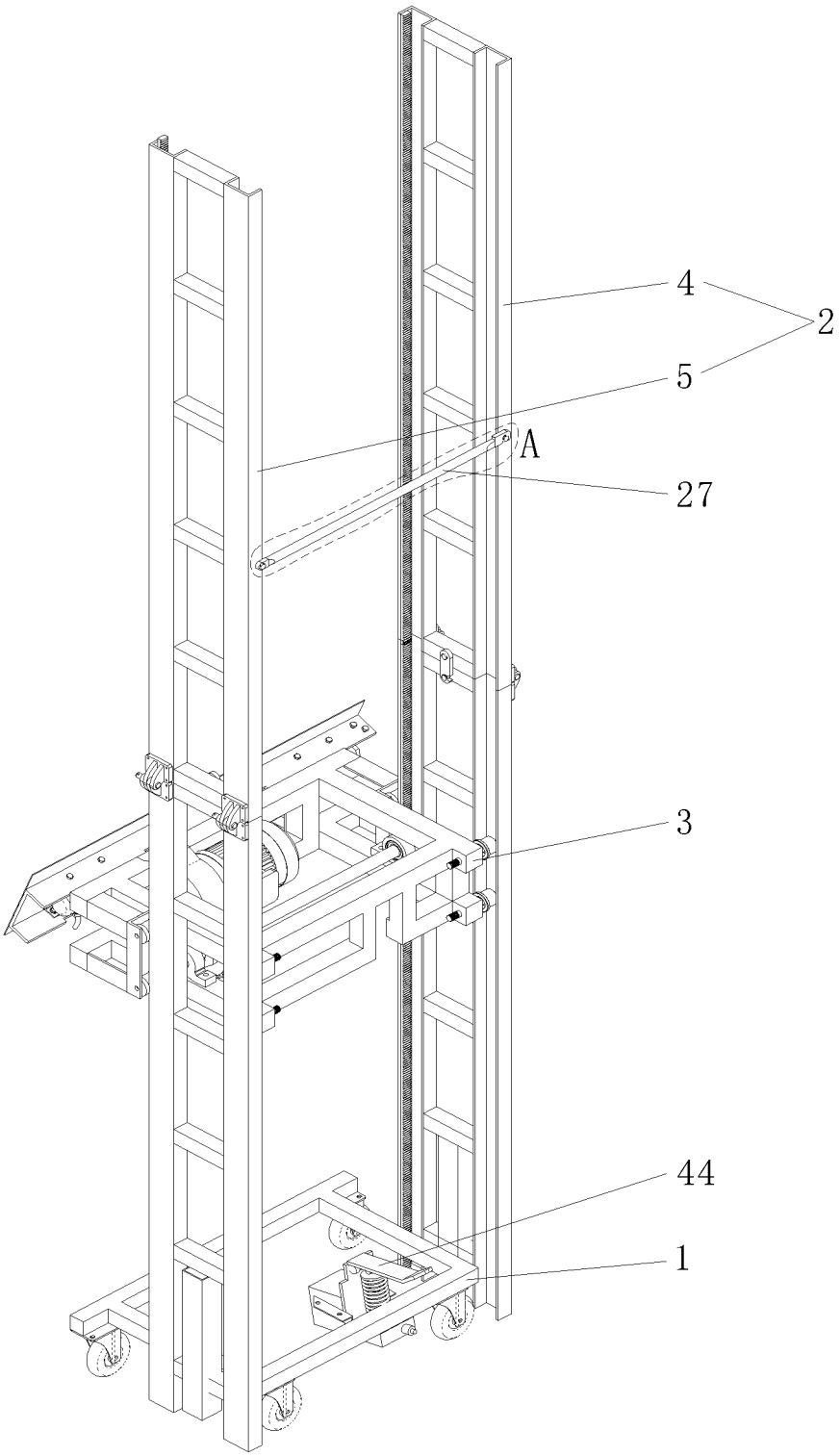
FIG. 1 is a schematic view of the plastering machine in Embodiment 1 of the present invention.
Figure 2:
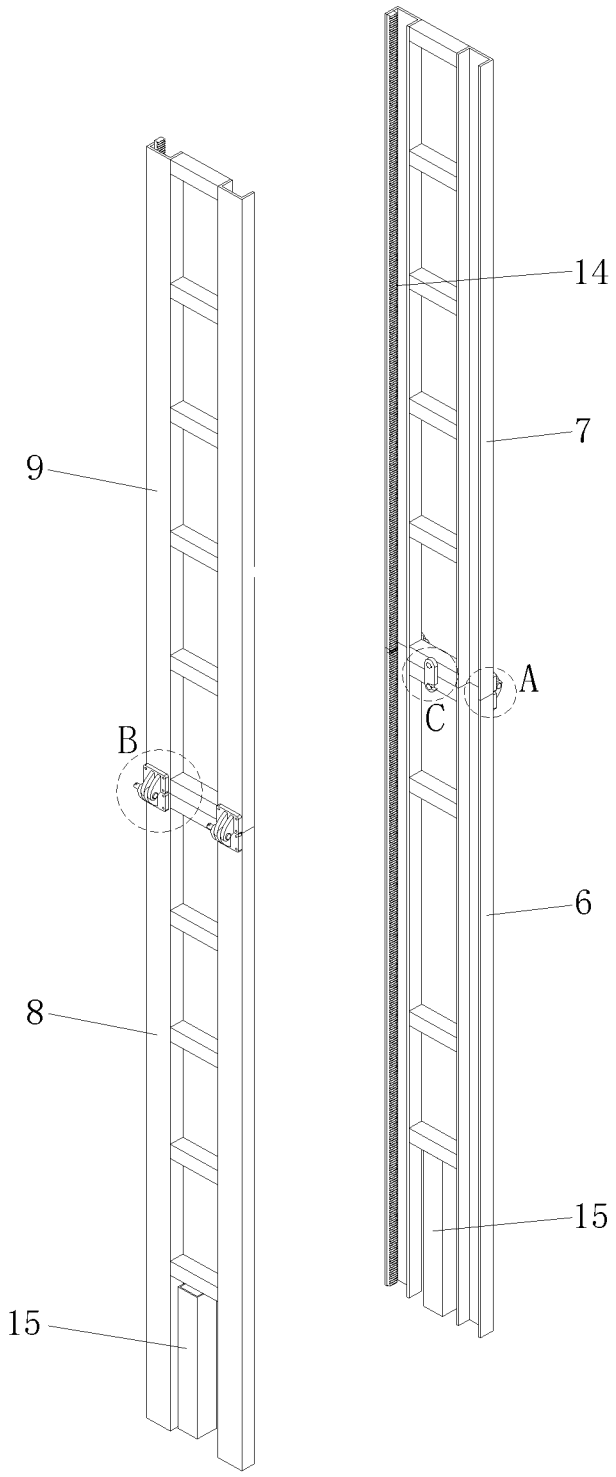
FIG. 2 is a schematic view of the upright rails in Embodiment 1 of the present invention.
Figure 3:
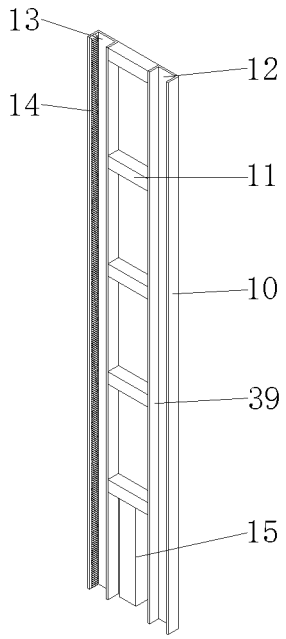
FIG. 3 is a schematic view of the first left rail piece in Embodiment 1 of the present invention.

As shown in FIGS. 1, 2 and 3, the plastering machine includes base 1, upright rail 2 and plastering machine pedestal 3, wherein upright rail 2 includes left rail 4 and right rail 5. Moreover, left rail 4 includes first left rail piece 6 and second left rail piece 7. Right rail 5 includes first right rail piece 8 and second right rail piece 9. First left rail piece 6 and first right rail piece 8 have the same structure. As shown in the drawings, taking first left rail piece 6 as an example, first left rail piece 6 includes two pieces of channel steel 10. A plurality of connecting rods 11 for fixing, are arranged between the two pieces of channel steel 10. Connecting rod 11 may be selected to be a square tube. Each of the two pieces of channel steel 10 is formed with moving groove 12 and accommodating groove 13, respectively. Rack 14 is mounted along the longitudinal direction of first left rail piece 6 inside accommodating groove 13. Positioning sleeve 15 is connected to the connecting rod 11 located at the longitudinal tail end of the first left rail piece 6. Positioning sleeve 15 has a hollow structure. The structures of second left rail piece 7 and second right rail piece 9 is substantially the same as those of the first left rail piece 6 and the first right rail piece 8 except that no positioning sleeves 15 are mounted on second left rail piece 7 and second right rail piece 9. Thus, the structures of second left rail piece 7 and second right rail piece 9 are not repeated hereinafter.

Figure 4:
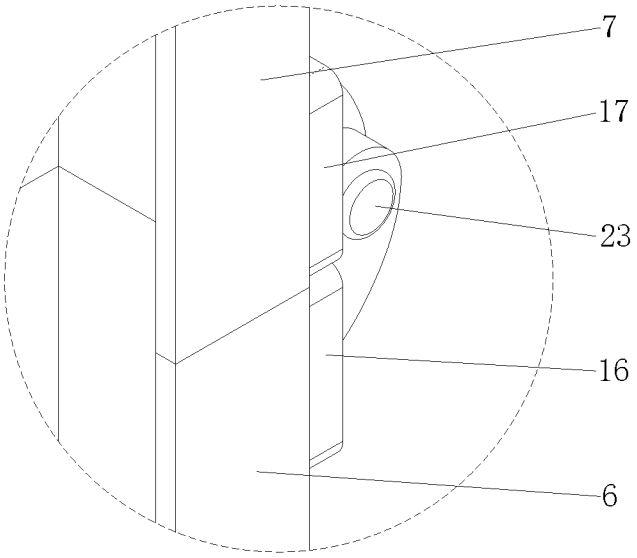
FIG. 4 is a partially enlarged view of A in FIG. 2.
Figure 5:
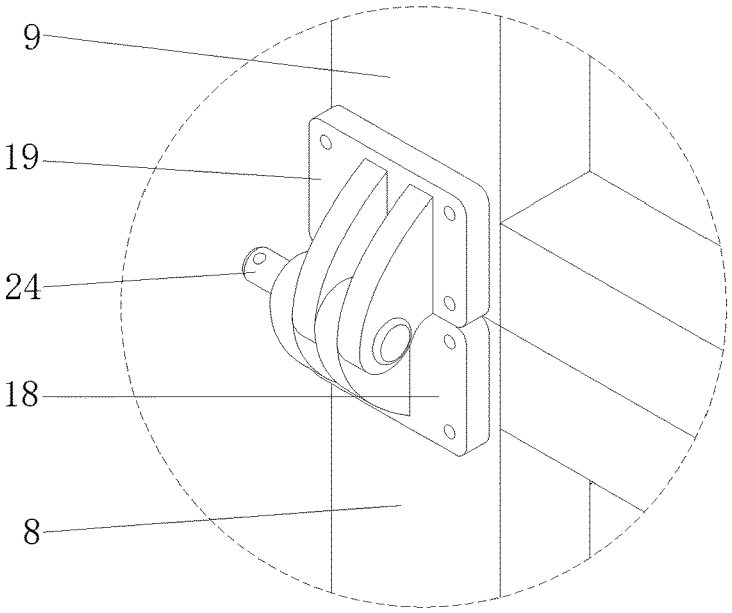
FIG. 5 is a partially enlarged view of B in FIG. 2.
Figure 6:
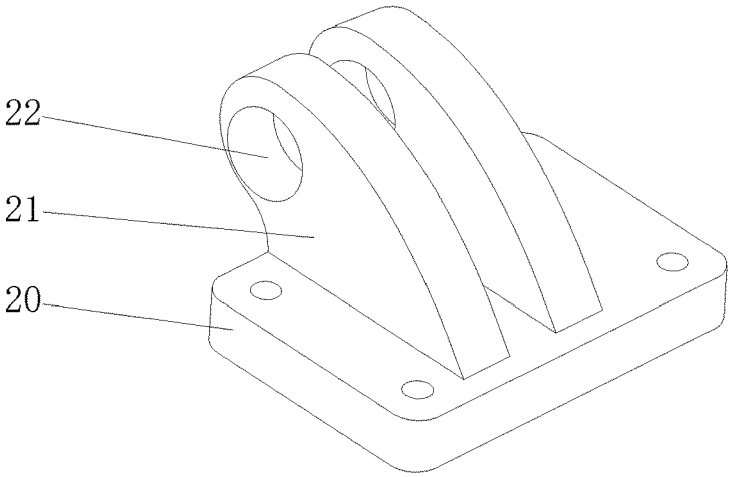
FIG. 6 is a schematic view of the first right rail articulation piece in Embodiment 1 of the present invention.

As shown in FIGS. 4, 5 and 6, in the ascending direction of plastering machine pedestal 3, second left rail piece 7 is located downstream with respect to first left rail piece 6. The longitudinal tail ends of first left rail piece 6 are provided with two first left rail articulation pieces 16. The longitudinal head ends of second left rail piece 7 are provided with two second left rail articulation pieces 17. In the ascending direction of plastering machine pedestal 3, second right rail piece 9 is located downstream with respect to first right rail piece 8. The longitudinal tail ends of first right rail piece 8 are provided with two first right rail articulation pieces 18. The longitudinal head ends of second right rail piece 9 are provided with two second right rail articulation pieces 19. First left rail articulation piece 16, second left rail articulation piece 17, first right rail articulation piece 18, and second right rail articulation piece 19 have the same structure. Taking first right rail articulation piece 18 as an example, as shown in the drawings, first left rail articulation piece 16 is formed by fixed plate 20. Fixed plate 20 is formed with two articulation lugs 21. Each articulation lug 21 is provided with hinge pin through hole 22. One first left rail articulation piece 16 and one second left rail articulation piece 17 make up a group. First hinge pin 23 passes through hinge pin through holes 22 of first left rail articulation piece 16 and second left rail articulation piece 17, so that first left rail articulation piece 16 and second left rail articulation piece 17 make up a set of articulation mechanism. One first right rail articulation piece 18 and one second right rail articulation piece 19 make up a group. Second hinge pin 24 passes through hinge pin through holes 22 of first right rail articulation piece 18 and second right rail articulation piece 19, so that first right rail articulation piece 18 and second right rail articulation piece 19 make up a set of articulation mechanism.

Figure 7:
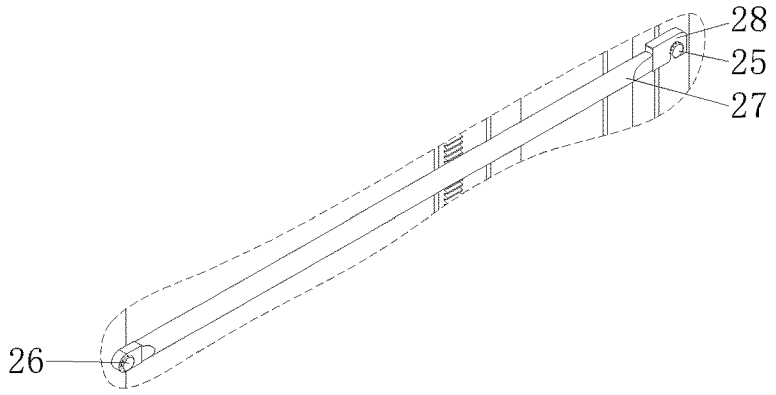
FIG. 7 is a partially enlarged view of A in FIG. 1.

As shown in FIG. 7, an outer side of second left rail piece 7 is formed with positioning pin 25 as the positioning jutting block. The upstream of second right rail piece 9 is provided with a rotary hinge pin 26 as a rotary pin portion. Positioning hook 27 is mounted on rotary hinge pin 26. Positioning hook 27 is rotatable with respect to the central axis of the rotary hinge pin. The tail end of positioning hook 27 is formed with positioning hook portion 28.

Figure 8:
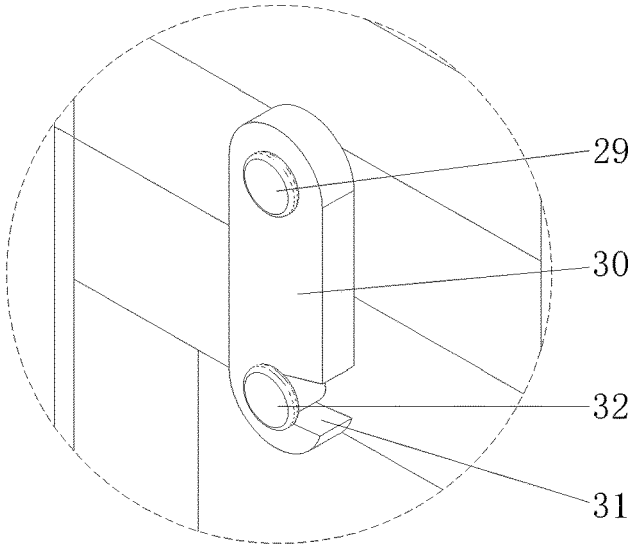
FIG. 8 is a partially enlarged view of C in FIG. 2.

As shown in FIG. 8, the inner side of second left rail piece 7 is also formed with fixing hinge pin 29 as a fixing pin portion. Fixing hinge pin 29 is located at the longitudinal head end of second left rail piece 7. Fixing hook 30 is mounted on fixing hinge pin 29. The tail end of fixing hook 30 is formed with hook portion 31. The longitudinal tail end of first left rail piece 6 is provided with fixing post 32 as a fixing block. Hook portion 31 forming the tail end of fixing hook 30 may be snapped on fixing post 32. Second right rail piece 9 and first right rail piece 8 are also respectively provided with structures of fixing hinge pin 29, fixing hook 30, etc. The structures of fixing hinge pin 29, fixing hook 30, etc. mounted on second right rail piece 9 and first right rail piece 8 are the same as those mounted on second left rail piece 7 and first left rail piece 6. Thus, the details would not be repeated hereinafter.

Figure 9:
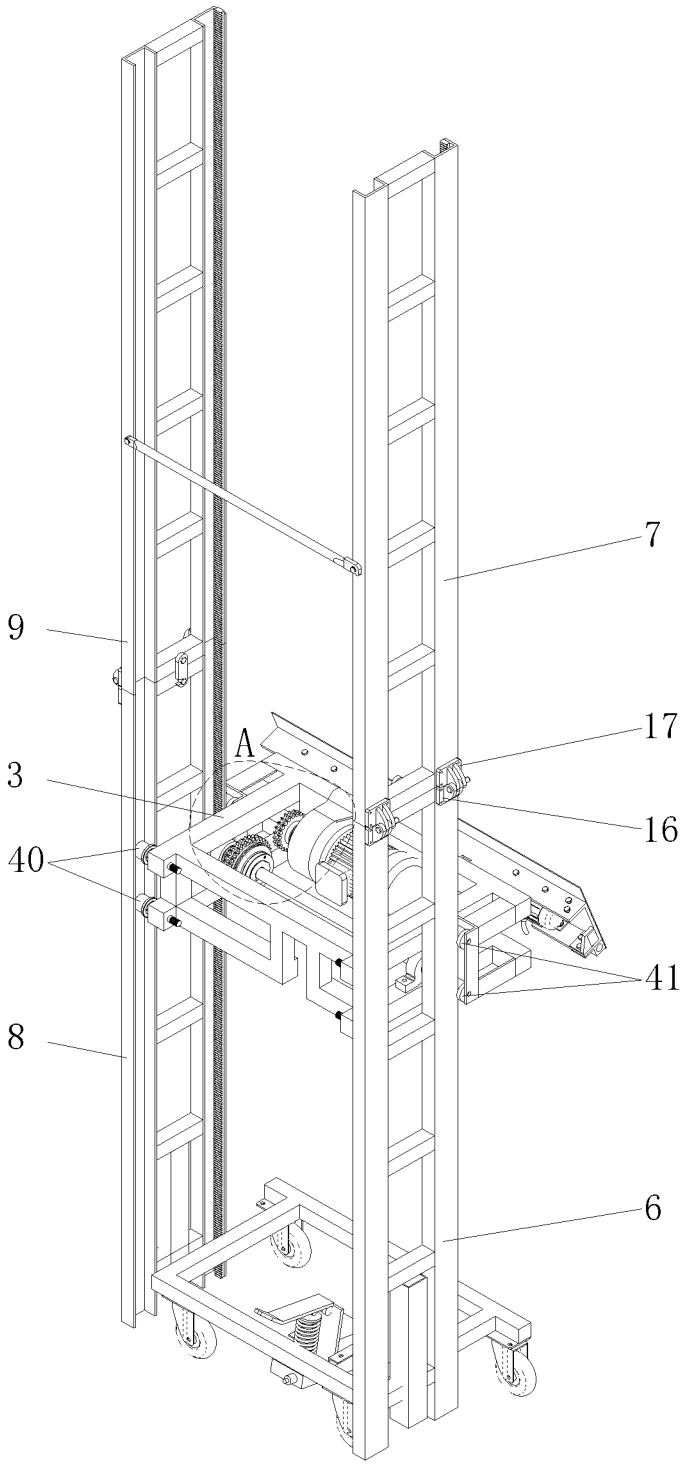
FIG. 9 is a schematic view of a plastering machine pedestal in Embodiment 1 of the present invention.
Figure 10:
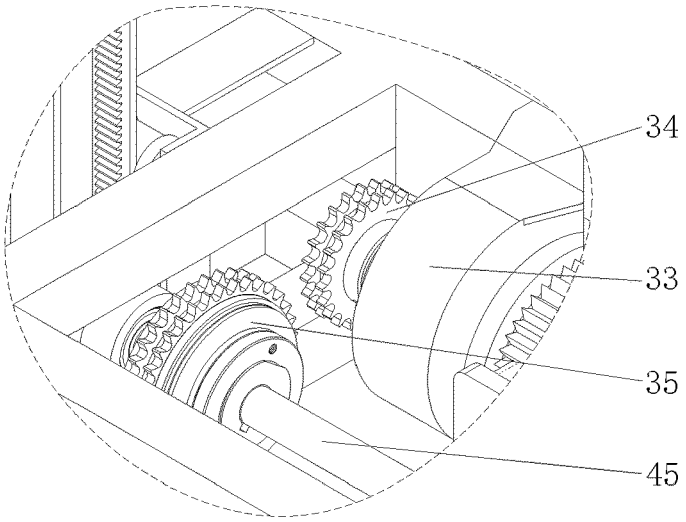
FIG. 10 is a partially enlarged view of A in FIG. 9.

As shown in FIGS. 9 and 10, driving motor 33 is mounted on the plastering machine pedestal 3. Driving sprocket 34 is connected to the output shaft of driving motor 33. In addition, plastering machine pedestal 3 is further provided with a driving shaft 45 which is individually rotatable with respect to plastering machine pedestal 3. The driving shaft 45 is provided with a following sprocket 35 matched with driving sprocket 34. Driving motor 33 can drive driving shaft 45 to rotate using the chain transmission. Both ends of the driving shaft 45 are further provided with gear 36 which meshes with rack 14.

Figure 11:
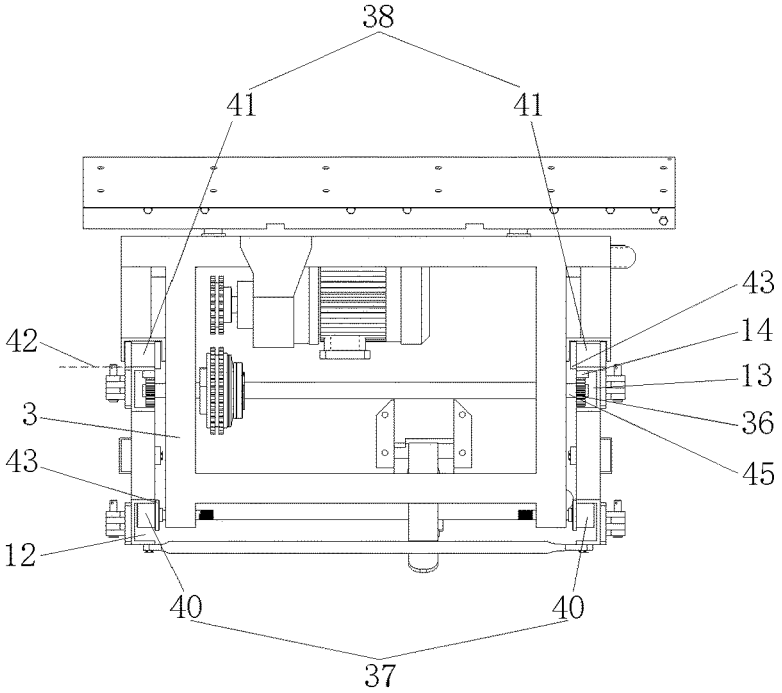
FIG. 11 is a schematic view of the first moving wheel group and the second moving wheel group in Embodiment 1 of the present invention.

As shown in FIG. 11, plastering machine pedestal 3 is further provided with first moving wheel group 37 and second moving wheel group 38 that are individually rotatable with respect to plastering machine pedestal 3. First moving wheel group 37 is located inside moving groove 12 and moves in first moving base surface 39. First moving base surface 39 is an inner end surface of one side of the moving groove 12. In the present embodiment, the first moving wheel group 37 is consist of four first moving wheels 40. Two first moving wheels 40 make up a group. Each of left rail 4 and right rail 5 is respectively provided with a group of first moving wheels 40. Similarly, second moving wheel group 38 is consist of four second moving wheels 41. Two second moving wheels 41 make up a group. Each of left rail 4 and right rail 5 is respectively provided with a group of second moving wheels 41. Second moving wheel group 38 moves on the outer surface of left rail 4 and right rail 5, i.e. the surface of the channel steel 10 with a narrow width, which is second moving base surface 42. Moreover, second moving base surface 42 is parallel to first moving base surface 39.

As shown in FIG. 11, each of first moving wheel 40 and second moving wheel 41 is formed with position limiting rim 43. Position limiting rim 43 closely fits the inner side of left rail 4 and the inner side of right rail 5 to ensure that plastering machine pedestal 3 does not shake with respect to upright rail 2 during the ascending or descending process of plastering machine pedestal 3.

The implementation of assembling the plastering machine is as follows.

Figure 12:
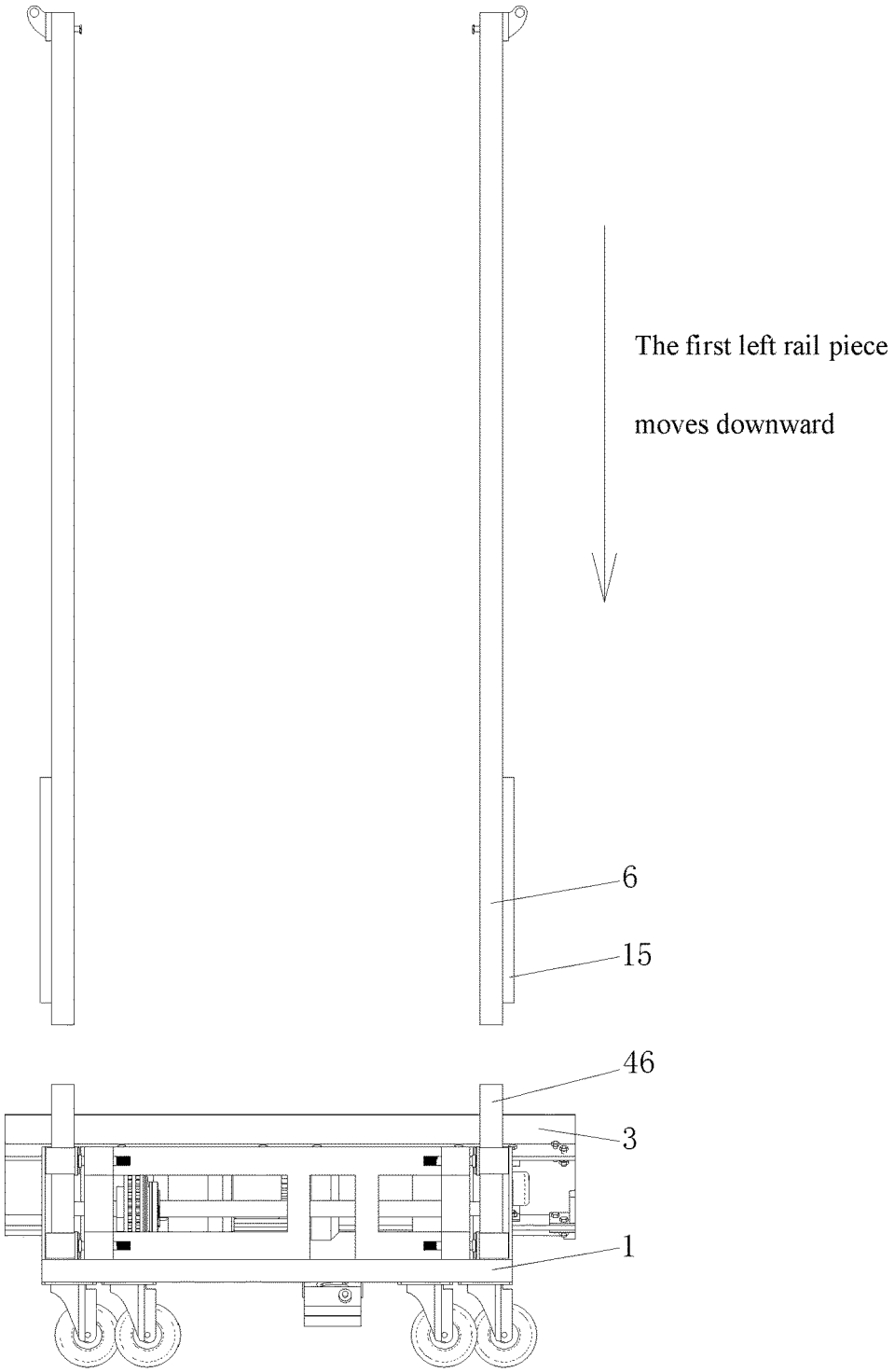
FIG. 12 is a schematic view of the first step of assembling the plastering machine in Embodiment 1 of the present invention.
Figure 13:
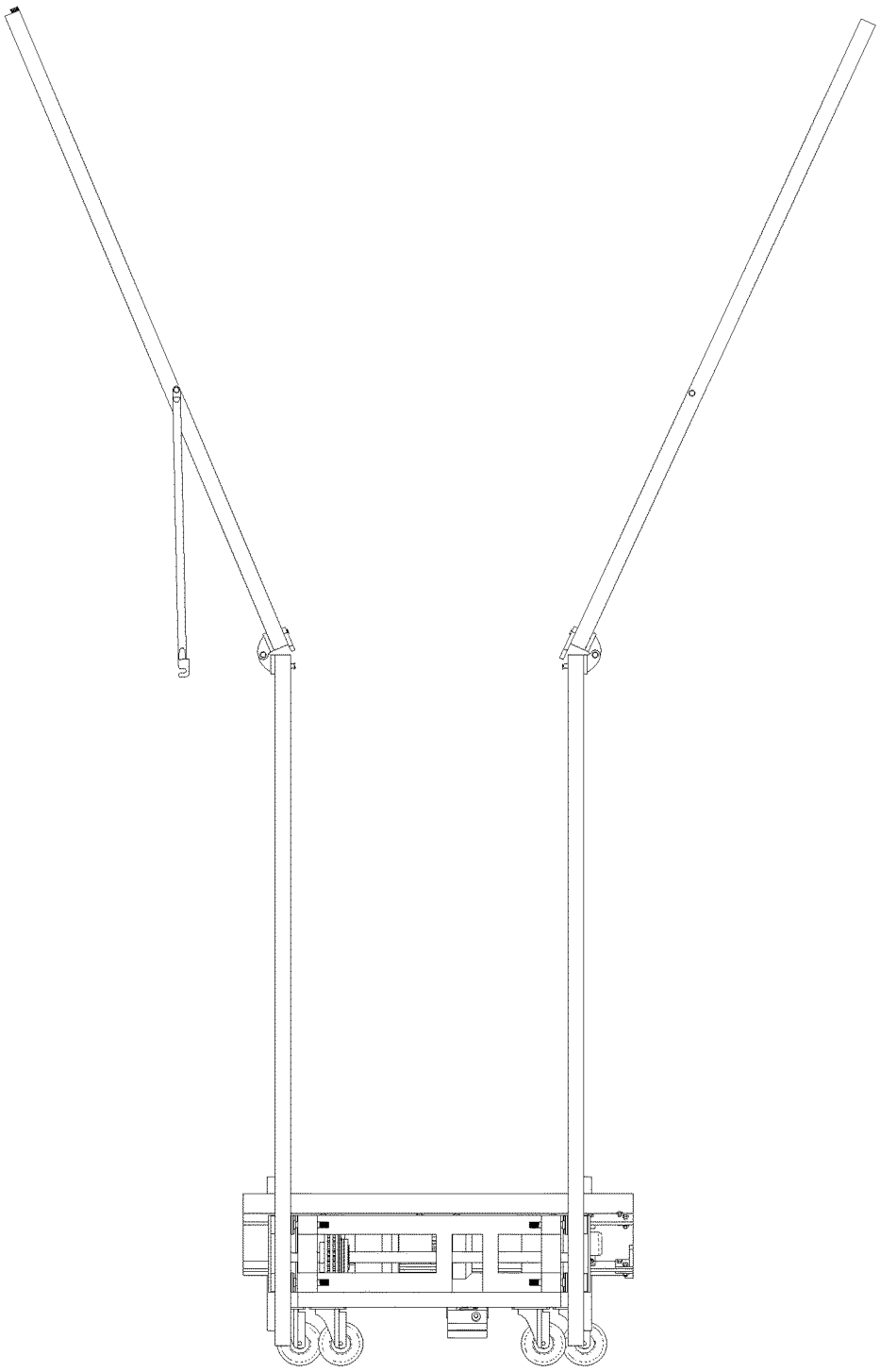
FIG. 13 is a schematic view of the second step of assembling the plastering machine in Embodiment 1 of the present invention.
Figure 14:
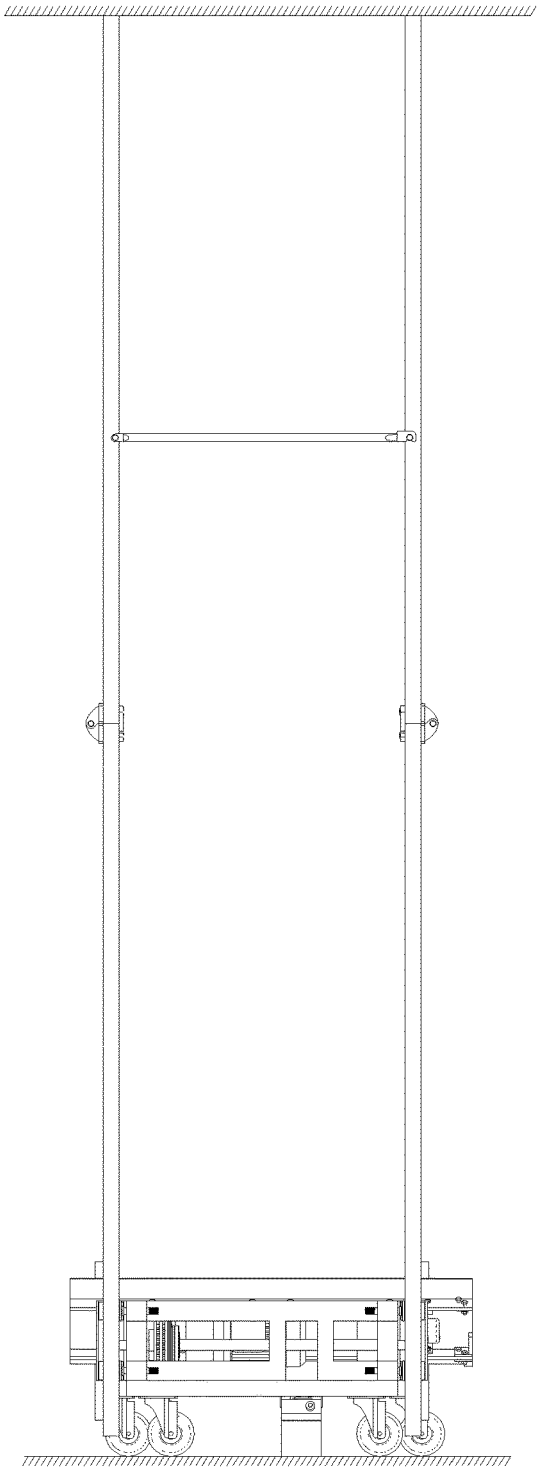
FIG. 14 is a schematic view of the third step of assembling the plastering machine in Embodiment 1 of the present invention.

As shown in FIGS. 12, 13 and 14, plastering machine pedestal 3 is placed on base 1. First left rail piece 6 and first right rail piece 8 are placed on both sides of plastering machine pedestal 3 so that gear 36 at both ends of driving shaft 45 can contact the racks 14 inside first left rail piece 6 and first right rail piece 8. Positioning sleeves 15 of first left rail piece 6 and first right rail piece 8 are aligned with positioning rods 46 on both sides of base 1 respectively. Subsequently, the worker starts driving motor 33 to make gear 36 climb longitudinally along rack 14. In accordance with the principle of force and reaction, rack 14 moves downward with respect to the previous rack 14 when gear 36 is climbing longitudinally along rack 14. Since the position of the plastering machine has not been fixed yet at this time, first left rail piece 6 and first right rail piece 8 are not reliably supported in the upright direction, the force imposed due to the ascending of plastering machine pedestal 3 cannot be withstood. Thus, first left rail piece 6 and first right rail piece 8 subsequently descend with respect to plastering machine pedestal 3, so that positioning rods 46 as the positioning blocks are stuffed into positioning sleeves 15 of first left rail piece 6 and first right rail piece 8 respectively. When positioning rods 46 are connected to positioning sleeves 15 in place, namely, first left rail piece 6 and first right rail piece 8 cannot continue to move downward with respect to plastering machine pedestal 3, the worker may turn off driving motor 33. At this point, first left rail piece 6 and first right rail piece 8 can be mounted on base 1, and plastering machine pedestal 3 is located between first left rail piece 6 and first right rail piece 8.

The worker puts second left rail piece 7 above first left rail piece 6 and aligns hinge pin through hole 22 of second left rail articulation piece 17 with hinge pin through hole 22 of first left rail articulation piece 16. First hinge pin 23 passes through second left rail articulation piece 17 and first left rail articulation piece 16, that is, second left rail piece 7 and first left rail piece 6 are hinged with each other. Second left rail piece 7 is rotatable around the central axis of first hinge pin 23 with respect to first left rail piece 6. Left rail 4 is now assembled and in an upright status. The principle of assembling right rail 5 is the same as that of left rail 4. Thus, the process would not be repeated hereinafter.

After left rail 4 and right rail 5 are assembled, the worker turn over second left rail piece 7 and second right rail piece 9 so as to align channel steel 10 constituting second left rail piece 7 with channel steel 10 constituting first left rail piece 6. First moving base surface 39 and rack 14 of second left rail piece 7 are aligned with first moving base surface 39 and rack 14 of first left rail piece 6 respectively. Similarly, second right rail piece 9 is aligned with first right rail piece 8. After that, the worker turns over positioning hook 27 so that the positioning hook portion 28 is snapped on positioning pin 25, and second left rail piece 7 and second right rail piece 9 are fixed. The worker turns over fixing hook 30 such that fasten hook portion 31 is snapped on fixing hinge pin 29. First left rail piece 6 is fixed to second left rail piece 7, and first right rail piece 8 is fixed to second right rail piece 9.

Subsequently, the worker may step on the pedal jack 44 mounted on the base 1 to make the bottom holding claw pushes against the ground and second left rail 7 and second right rail 9 push against the ceiling. So far, the preparatory works are completed before the operation of the plastering machine.

The process of the ascending of plastering machine pedestal 3 from a lower position to a higher position is as follows.

Figure 15:
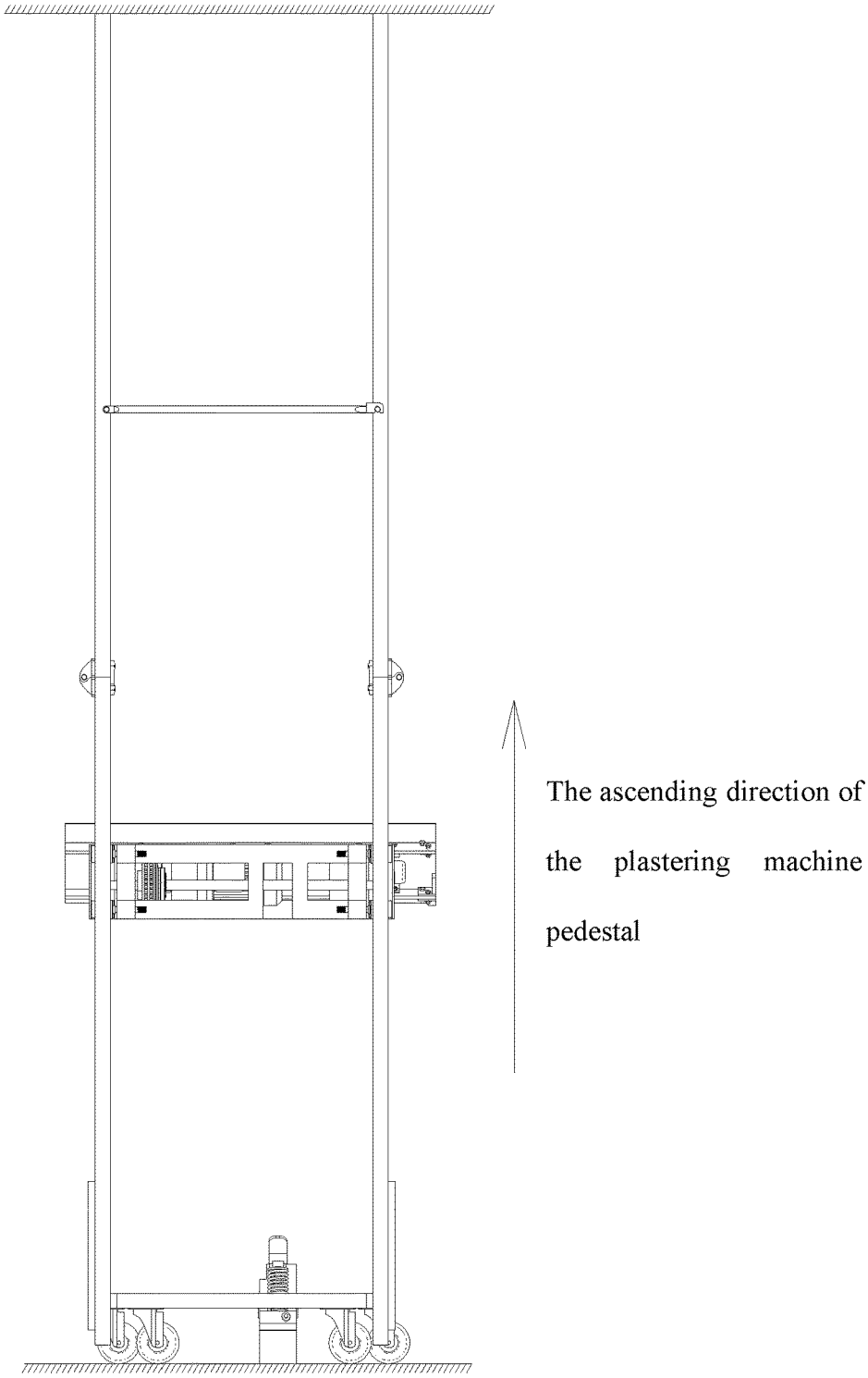
FIG. 15 is a schematic view of the ascending of the plastering machine pedestal from a lower position to a higher position in Embodiment 1 of the present invention.

As shown in FIG. 15, the driving motor 33 is started. Driving motor 33 drives driving shaft 45 to rotate with respect to plastering machine pedestal 3, so that gear 36 mounted on both ends of driving shaft 45 moves on rack 14, thereby driving plastering machine pedestal 3 to ascend from the lower position to the higher position.

The process of plastering machine to descend from the higher position to the lower position is the same as that of plastering machine pedestal 3 to ascend from the lower position to the higher position, except that the driving motor 33 needs be reversed. The process would not be repeated hereinafter.

The disassembling of the plastering machine is as follows.

After the plastering operation is completed, the worker may firstly release the pressure applied by pedal jack 44 so that second left rail piece 7 and second right rail piece 9 do not push against the ceiling anymore. After that, positioning hook 27 and fixing hook 30 are turned over so that positioning hook portion 28 and hook portion 31 are detached from positioning pin 25 and fixing hinge pin 29 respectively. Next, first hinge pin 23 and second hinge pin 24 are removed such that second left rail piece 7 is detached from first left rail piece 6 and second right rail piece 9 is detached from first right rail piece 8.

When first left rail piece 6 and first right rail piece 8 are removed, the worker needs to start driving motor 33 to make gear 36 move longitudinally downward along rack 14. At this time, similarly to the scenario when first left rail piece 6 and first right rail piece 8 are set up, since the plastering machine is not fixed in place, first left rail piece 6 and first right rail piece 8 are not reliably supported in the upright direction. Thus, the force imposed due to the descending of plastering machine pedestal 3 cannot be withstood. Thus, first left rail piece 6 and first right rail piece 8 subsequently ascend with respect to plastering machine pedestal 3, so that positioning sleeves 15 of first left rail piece 6 and first right rail piece 8 are removed from positioning rod 46. After racks 14 inside first left rail piece 6 and first right rail piece 8 are completely separated from gear 36 of plastering machine pedestal 3, the worker can remove first left rail piece 6 and first right rail piece 8. At this point, the process of disassembling the plastering machine is completed. The worker can take away the plastering machine through the doorway directly. The transportation is very convenient.

Embodiment 2

Figure 16:
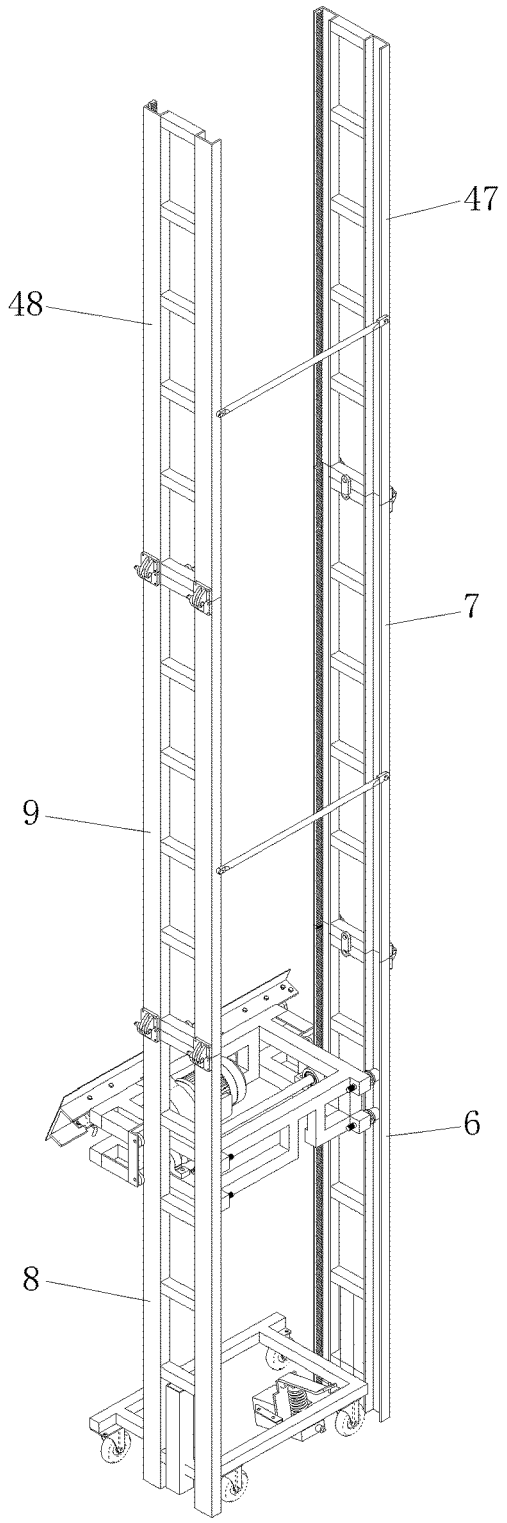
FIG. 16 is a schematic view of the plastering machine in Embodiment 2 of the present invention.

The differences between Embodiment 2 and Embodiment 1 are as follows. As shown in FIG. 16, left rail is consist of first left rail piece 6, second left rail piece 7, and third left rail piece 47. The right rail is consist of first right rail piece 8, second right rail piece 9, and third right rail piece 48. The structures of third left rail piece 47 and third right rail piece 48 are the same as those of second left rail piece 7 and second right rail piece 9 respectively. Third left rail piece 47 is located downstream with respect to the second left rail piece 7 along the ascending direction of the plastering machine. Third right rail piece 48 is located downstream with respect to second right rail piece 9 in the ascending direction of the plastering machine.

The connection structures of third left rail piece 47, third right rail piece 48 and second left rail piece 7, second right rail piece 9 are the same as those of second left rail piece 7, second right rail piece 9 and first left rail piece 6, first right rail piece 8 respectively. Thus, the structure would not be repeated hereinafter.

What is claimed is:

1. A platform for a plastering machine, comprising a base;

a plurality of upright rails, wherein the plurality of upright rails are foldable; and a plastering machine pedestal;

wherein the plurality of upright rails are mounted on the base;

the plurality of upright rails include a left rail and a right rail;

the left rail includes at least a first left rail piece and a second left rail piece;

the right rail includes at least a first right rail piece and a second right rail piece;

the first left rail piece is mounted on the base;

the second left rail piece is located downstream with respect to the first left rail piece along an ascending direction of the plastering machine pedestal;

the second left rail piece is capable of rotating around a longitudinal tail end of the first left rail piece with respect to the first left rail piece;

the first right rail piece is also mounted on the base;

the second right rail piece is located downstream with respect to the first right rail piece along the ascending direction of the plastering machine pedestal;

the second right rail piece is capable of rotating around a longitudinal tail end of the first right rail piece with respect to the first right rail piece;

each of the first left rail piece, the second left rail piece, the first right rail piece, and the second right rail piece is provided with a moving groove and an accommodating groove arranged along the longitudinal direction thereof;

a first moving base surface is formed inside the moving groove;

a rack is arranged inside the accommodating groove along a longitudinal direction of the accommodating groove;

the plastering machine pedestal is provided with a driving motor;

an output shaft of the driving motor is connected to a gear;

the gear is individually rotatable with respect to the driving motor;

the gear is engaged with the rack;

the plastering machine pedestal is further provided with a first moving wheel group and a second moving wheel group;

the first moving wheel group and the second moving wheel group are individually rotatable with respect to the plastering machine pedestal;

the first moving wheel group moves on the first moving base surface;

the second moving wheel group moves on a second moving base surface;

the second moving base surface is formed on an outer side of the accommodating groove; and the second moving base surface is parallel to the first moving base surface.

2. The platform for the plastering machine according to claim 1, wherein, a structure of each of the first left rail piece, the second left rail piece, the first right rail piece, and the second right rail piece includes two pieces of paralleled channel steel;

the moving groove is formed inside either one of the two pieces of channel steel, and the accommodating groove is formed inside the other one of the two pieces of channel steel; and a plurality of connecting rods for fixing is arranged between the two pieces of channel steel.

3. The platform for the plastering machine according to claim 1, wherein, a longitudinal tail end of the first left rail piece is provided with a first left rail articulation piece;

a longitudinal head end of the second left rail piece is provided with a second left rail articulation piece;

the first left rail articulation piece is mounted to the second left rail articulation piece correspondingly;

the first left rail articulation piece is connected to the second left rail articulation piece via a first hinge pin;

the longitudinal tail end of the first right rail piece is provided with a first right rail articulation piece;

the longitudinal head end of the second right rail piece is provided with a second right rail articulation piece;

the first right rail articulation piece is mounted to the second right rail articulation piece correspondingly, and the first right rail articulation piece is connected to the second right rail articulation piece via a second hinge pin.

4. The platform for the plastering machine according to claim 2, wherein, a structure of each of the first left rail articulation piece, the second left rail articulation piece, the first right rail articulation piece, and the second right rail articulation piece includes a fixing plate;

the fixing plate is formed with at least one articulation lug; and the at least one articulation lug is provided with a hinge pin through hole for the first hinge pin or the second hinge pin to pass through.

5. The platform for the plastering machine according to claim 1, wherein, a positioning mechanism is provided between the second left rail piece and the second right rail piece; and the positioning mechanism is configured to fix a relative position of the second left rail piece with respect to the second right rail piece.

6. The platform for the plastering machine according to claim 5, wherein, the positioning mechanism comprises a positioning jutting block and a positioning hook;

the positioning jutting block is arranged on either the second left rail piece or the second right rail piece;

the positioning hook is arranged to the other one of the second left rail piece and the second right rail piece;

the positioning hook is individually rotatable with respect to the rail piece on which the positioning hook is located;

the positioning hook is formed with a positioning hook portion; and the positioning hook portion is capable of hooking up to the positioning jutting block.

7. The platform for the plastering machine according to claim 1, wherein, each of the longitudinal tail end of the first left rail piece and the longitudinal tail end of the first right rail piece is provided with a fixing block;

each of the longitudinal head end of the second left rail piece and the longitudinal head end of the second right rail piece is provided with a fixing pin portion;

the fixing pin portion is provided with a fixing hook;

the fixing hook is rotatable with respect to the fixing pin portion;

the fixing hook is formed with a hook portion; and the fixing hook is capable of snapping on to the fixing block.

8. The platform for the plastering machine according to claim 1, wherein, each of the first moving wheel group and the second moving wheel group includes a plurality of moving wheels;

each moving wheel is formed with a position limiting rim; and the position limiting rim is arranged on an end face of the moving wheel and around a rotation axis of the moving wheel.

9. The platform for the plastering machine according to claim 1, wherein, each of the left side and right side of the base is provided with a positioning block; and a positioning sleeve corresponding to the positioning block is arranged on each of the first left rail piece and first right rail piece.

10. The platform for the plastering machine according to claim 1, wherein, the base is provided with a jack; and the jack is provided with a bottom holding claw; and the holding claw is arranged to push against ground.

* * * * *